United States Patent [19]

Heidotting et al.

[11] Patent Number: 4,940,428

[45] Date of Patent: Jul. 10, 1990

[54] ELECTRICAL CONNECTOR WITH RESILIENT RETAINING MEANS

[75] Inventors: Werner Heidotting, Munster; Wolfgang Scheffner, Roedermark; Willi Duerkop, Reinheim, all of Fed. Rep. of Germany

[73] Assignee: C. A. Weidmueller GmbH & Co., Detmold, Fed. Rep. of Germany

[21] Appl. No.: 327,091

[22] Filed: Mar. 22, 1989

[30] Foreign Application Priority Data

Mar. 26, 1988 [EP] European Pat. Off. ..... 88104898-7

[51] Int. Cl.[5] ..... H01R 13/40

[52] U.S. Cl. ..... 439/598; 439/95; 439/599; 439/355

[58] Field of Search ..... 439/95, 299, 355, 598–600, 439/713

[56] References Cited

U.S. PATENT DOCUMENTS

| | | | |
|---|---|---|---|
| 4,601,527 | 7/1986 | Lemke | 439/95 |
| 4,699,438 | 10/1987 | Kikuta | 439/95 |
| 4,717,359 | 1/1988 | Rahrig et al. | 439/598 |
| 4,718,857 | 1/1988 | Noschese | 439/355 |
| 4,789,346 | 12/1988 | Frantz | 439/599 |
| 4,842,529 | 6/1989 | Frantz et al. | 439/95 |

FOREIGN PATENT DOCUMENTS 3620719 12/1987 Fed. Rep. of Germany .

*Primary Examiner*—P. Austin Bradley

*Attorney, Agent, or Firm*—Laubscher, Presta & Laubscher

[57] ABSTRACT

An electrical connector (2) is adapted at its forward end for insertion from the rear forwardly within a through opening (10) contained in a base member (1). A snap fastener retaining arrangement including a pair of resiliently outwardly biased hook members (6) on opposite sides of the connector is adapted to automatically engage corresponding shoulders on the base member when the connector has been inserted to a given position within the base member opening. The connector is thus releasably retained in position, whereupon the connector may be rigidly fastened to the base member by second fastener devices (4) operable from the front of the base member. Upon disconnection of the second fastener devices, the hook members may be manually compressed inwardly toward the connector to release the snap fastener retaining arrangement, whereupon the connector may be withdrawn from the base member opening.

10 Claims, 1 Drawing Sheet

ELECTRICAL CONNECTOR WITH RESILIENT RETAINING MEANS

STATEMENT OF THE INVENTION

Resilient retaining hooks extend laterally outwardly on opposite sides of a male connector for automatically retaining the connector—when inserted from the rear forwardly within an opening contained in a base plate member—in place relative to the base member, whereupon the connector may be rigidly connected with the base plate by second fastener means operable from the front of the base member.

As shown by the German Ausgelegeschrift No. 3620719, it is known to provide an electrical plug connector—with or without a test adapter connected thereto—that is adapted for insertion, from within—into an opening contained in a base member mounted on a switchboard housing; this manner of insertion is preferred for many reasons, including the fact that the assembly can be done by just one person. When using this method, the assembler can—when working from within owing to the previous mounting by means of locking elements—after the preliminary mounting operation, for example—go around the switchboard to get to the outside thereof, thereby to screw the connector to the base member in a fixed manner.

In the known electrical plug connectors, the locking elements include wedge or key lugs provided on the inner walls of the base member arranged for cooperation with corresponding retaining ribs arranged on the longitudinal sides of the connector member, whereby upon insertion from the inside of the housing, the ribs are pressed to effect a snap connection with the wedge lugs. As a consequence of this design of the locking elements for premounting of the connector, it is difficult to disconnect the parts without damage to the locking elements in the event that it is desired (for example, upon discovery of a mistake) to separate the elements.

The present invention was developed to provide an electrical plug connector of the type wherein the connector member, if necessary, can be easily, and without the use of special tools, be removed from its preliminary mounting position in the base part.

SUMMARY OF THE INVENTION

Accordingly, a primary object of the present invention is to provide a connector member including on opposite lateral sides thereto resiliently outwardly biased snap fastener hook members adapted for engagement with corresponding shoulders on a base member when the forward end of the connector is inserted from the rear side of the base member to a given position within a through opening contained therein. In the event that disconnection of the connector might be desired, the resilient snap fastener hooks may be simply compressed inwardly toward the connector, thereby to permit withdrawal of the connector rearwardly of the base member. On the other hand, when the snap fastener hooks retain the connector forward end in a preliminarily mounted condition relative to the base plate, the assembler may subsequently rigidly connect the connector with the base plate by rigid fastener means, such as screws, operable from the front side of the base plate. By arranging the resilient hook members on the narrow sides of the connector member, they may be easily grasped for handling the connector member when a conventional test adapter is connected thereto.

According to another object of the invention, the resilient hook members are preferably mounted on longitudinal ribs provided on the two narrow sides of the connector body. In the preferred embodiment, these mounting ribs are defined by the conductive ground bar conductors that are fastened at their forward ends in corresponding grooves formed in the external surface of the non-conductive connector body, which ground bars extend longitudinally rearwardly beyond the connector body and terminate at their rear ends in lateral ears upon which the grounding terminals are mounted. In this manner, a very simple design structure is provided, in that the resilient hook members may be of U-shaped configuration to define a pair of legs one of which carries the snap-fastener hook and the other of which carries a pair of spaced clip fasteners for clipping the resilient member to the aforementioned ground bar conductor.

BRIEF DESCRIPTION OF THE DRAWING

Other objects and advantages of the invention will become apparent from a study of the following specification, in which.

DETAILED DESCRIPTION

Figure 1:
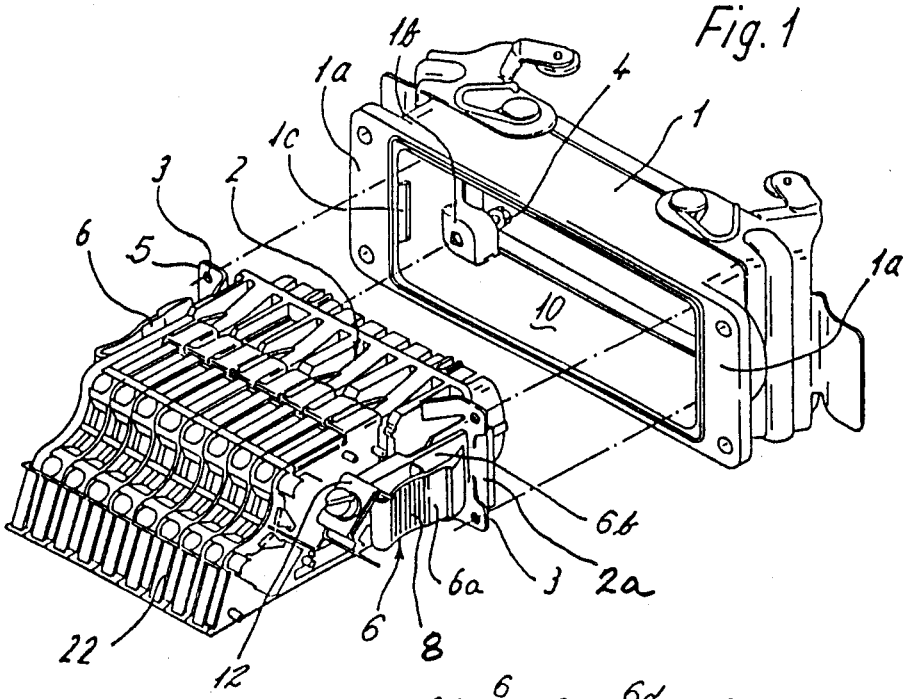
FIG. 1 is an exploded rear view of the connector and base members in a disassembled condition, with the test adapter device mounted on the connector body.
Figure 2:
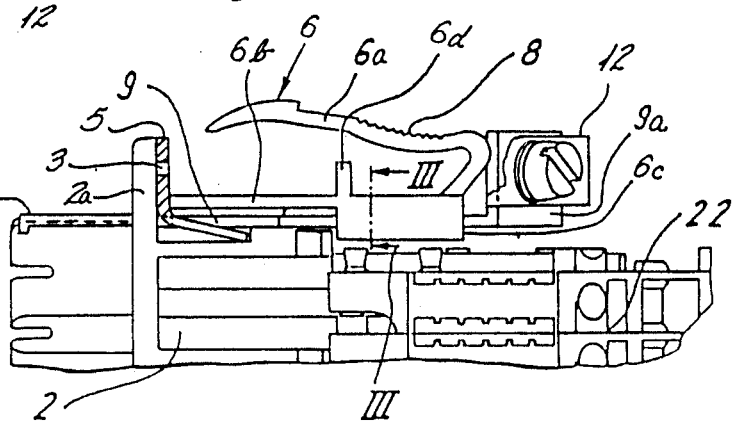
FIG. 2 is a detailed view illustrating the mounting of the resilient hook member on the external rear end portion of the longitudinally extending ground bar conductor.
Figure 3:
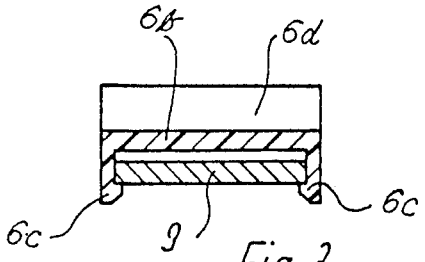
FIG. 3 is a detailed view taken along line III—III of FIG. 2.

Referring first more particularly to FIG. 1, the connector assembly includes a base plate 1 containing a through passage 10 of rectangular cross section, which base plate, when viewed from the rear, includes on opposite sides of the opening rear wall portions 1*a* that carry stop shoulders 1*c*, respectively.

Adapted for insertion at its forward end from the rear within the base plate passage 10 is a connector body 2 formed of suitable synthetic plastic electrical insulating material (such as a phenol resin, for example) and provided with the conventional longitudinally extending electrical male or female terminals (not shown). To the rear end of the connector body is removably mounted a conventional test adapter 22, which, per se, forms no part of the present invention.

The connector body is provided at its forward end with a transverse metal mounting plate 5 including ear portions containing threaded openings 3 for receiving the fastening screws 4 that extend, in aligned relation to the threaded bores 3, rearwardly through bores contained in internal stop shoulders 1*b* formed within the connector body adjacent the forward wall thereof. Thus, when the connector body 2 had been inserted within passage 10 to such a position that the end flange surface 2*a* of the connector abuts the internal shoulders 1*b* in the base plate, the screw fasteners may be operated by the assembler from the front of the base plate to threadably engage the screws with the corresponding threaded openings contained in the mounting ears, thereby to rigidly fasten the connector body 2 with the base plate 1.

The connector body 2 is provided on each of its opposite narrow sides with a longitudinally extending ground bar conductor 9 the rear end portion of which extends rearwardly beyond the connector body 2 and terminates in a lateral ear portion 9*a* that carries the grounding wire terminal 12. At its forward end 9*b*, the ground bar conductor is permanently secured within a corresponding groove formed in the external surface of the molded synthetic plastic electrically-insulating connector body.

In accordance with a characterizing feature of the present invention, snap fastener retaining means (in the form of resilient hook members 6) are provided for automatically releasably retaining the connector body 2 in position when introduced from the rear to a given extent within the base plate passage 10, whereby the installer may, from the front of the switch panel or the like (to which the base plate is secured) permanently fasten the connector to the base plate by means of the screws 4. These snap fastener restraining means include a pair of resilient U-shaped members 6 having a pair of leg portions 6*a* and 6*b* that are resiliently biased apart. The leg portion 6*a* carries a hook on its external surface arranged to snap behind the associated base plate shoulder 1*c* when the connector body is fully inserted within the base plate passage 10. The other leg portion 6*b* of the resilient hook member includes a pair of spaced clip portions 6*c* that engage opposite sides of, and afford a snap fit connection of the hook member 6 to, the rear end portion of the ground bar connector 9. Preferably, the forward end of the leg portion 6*b* engages the rear surface of the mounting plate 5 to limit the extent of forward travel of the hook member 6 relative to the connector body 2.

In order to disconnect the connector body 2 from the base plate 1, the installer merely unfastens the screw thread fasteners 4 from the front side of the base plate, and from the rear side of the base plate, manually simultaneously compresses the two hook portions inwardly together toward the connector body to release the hooks from the associated shoulders 1*c*, thereby to permit withdrawal of the connector body from the base plate passage. To this end, the remote surfaces of the hook portions are provided with recesses 8 for receiving the installer's thumb and one finger, respectively, for compressing the hook portions together and thereby release the same from the base plate. In order to limit the extent of movement of the hook leg 6*a* in the direction of hook leg 6*b*, the hook leg 6*b* is provided with a stop 6*c* that extends laterally toward the hook leg 6*a*.

It will be seen that connection and disconnection of the connector body 2 to the base plate 1 is independent of whether or not the test adapter 22 has been connected with the rear end of the connector body.

While in accordance with the provisions of the Patent Statutes the preferred form and embodiment of the invention has been illustrated and described, changes may be made without deviating from the inventive concepts set forth above.

What is claimed is:

1. Electrical connector apparatus, comprising:

(a) a base member (1) having front and rear walls, said base member containing a through opening (10) extending between said front and rear walls;

(b) a connector member (2) having a forward end adapted for progressive insertion within said base member opening in the direction from said rear wall toward said front wall;

(c) resilient snap fastener means operable upon insertion of said connector member to a given position within said opening relative to said base member for automatically connecting said connector member with said base member; and (d) means (4) operable from the front of said base member for rigidly connecting said connector with said base member;

(e) said resilient snap fastener means including at least two resiliently outwardly-biased hook members (6) arranged on opposite sides of said connector member for engagement with corresponding retaining shoulders (1*c*) on said base member adjacent opposite sides of said opening, respectively, thereby to prevent withdrawal of said connector member from said opening;

(f) said hook members including means (8) arranged rearwardly of said base member rear wall for compressing said hook members to disengage the same from said base member, thereby to permit removal of said connector member from said opening.

2. Apparatus as defined in claim 1, wherein said connector member and said base member opening have corresponding rectangular cross-sectional configurations, and further wherein said hook members and said retaining shoulders are arranged on the narrow sides of said connector member and said base member opening, respectively.

3. Apparatus as defined in claim 1, wherein said base member contains stoop shoulder means (1*b*) in said opening adjacent the front wall of said base member, and wherein said connector member includes adjacent its forward end an end portion (2*a*) adapted to engage said stop shoulders when said connector is inserted to said given position in said opening, and further wherein said means for rigidly connecting said connector with said base member includes screw means (4) having their head portions adjacent the front face of said base member, said screw means having threaded portions that extend rearwardly through openings contained in said stop shoulders for threaded engagement with corresponding threaded bores (3) carried by said connector, respectively.

4. Apparatus as defined in claim 1, and further including test adapter means (22) connected with the rear end of said connector.

5. Electrical connector apparatus, comprising:

(a) base member (1) having front and rear walls, said base member containing a through opening (10) extending between said front and rear walls;

(b) a connector member (2) having a forward end adapted for progressive insertion within said base member opening in the direction from said rear wall toward said front wall, said connector member and said base member opening having corresponding rectangular cross-sectional configurations, each narrow side of said connector member including longitudinally extending external rib means, respectively;

(c) resilient snap fastener means operable upon insertion of said connector member to a given position within said opening relative to said base member for automatically connecting said connector member with said base member; and (d) means (4) operable from the front of said base member for rigidly connecting said connector with said base member;

(e) said resilient snap fastener means including at least two resiliently outwardly-biased hook member (16) mounted on said longitudinally-extending rib means, respectively, for engagement with corresponding retaining shoulders (1*c*) on said base member adjacent opposite sides of said opening, respectively, thereby to prevent withdrawal of said connector member from said opening.

6. Apparatus as defined in claim 5, wherein each of said hook members (6) has a generally U-shaped configuration including a pair of leg portions (a,6*b*) that are normally resiliently biased apart, a first one (a) of said leg portions having a hook for engaging the associated base member shoulder, and means for mounting said hook members on said rib means, respectively, each of said hook member mounting means including a pair of spaced resilient clip portions (6*c*) for receiving therebetween the associated longitudinally extending rib means, thereby to clip said hook member to said rib means.

7. Apparatus as defined in claim 6, wherein one leg portion of each of said hook members carries on the surface thereof adjacent the other leg portion a stop portion (6*d*) for limiting the extent of movement of said one leg portion in the direction of said other leg portion.

8. Apparatus as defined in claim 7, wherein the surfaces of said first leg portions (a) of said hook members (6) remote from the other leg portions contain recesses (8), whereby the user may grip the grooves by the thumb and one finger of one hand to compress the hook members together toward said connector member, thereby to release said snap fastener means to permit removal of said connector from said opening.

9. Apparatus as defined in claim 6, wherein said connector member is molded from an electrically non-conductive insulating material, and further wherein said longitudinally extending rib comprises an electrical conductor member (9) mounted at its forward end on, and extending longitudinally rearwardly beyond, said connector body.

10. Apparatus as defined in claim 9, wherein said conductor member includes at its rear end a lateral ear portion (9*a*), and terminal means (12) for connecting a ground wire to said conductor ear portion.

* * * * *